US009290933B2

(12) United States Patent
Balducci, Jr.

(10) Patent No.: US 9,290,933 B2
(45) Date of Patent: Mar. 22, 2016

(54) INTERLOCKING MASONRY UNIT

(71) Applicant: Joe Balducci, Jr., Cleveland, MS (US)

(72) Inventor: Joe Balducci, Jr., Cleveland, MS (US)

( * ) Notice: Subject to any disclaimer, the term of this patent is extended or adjusted under 35 U.S.C. 154(b) by 0 days.

(21) Appl. No.: 14/518,207

(22) Filed: Oct. 20, 2014

(65) Prior Publication Data

US 2015/0033660 A1 Feb. 5, 2015

Related U.S. Application Data

(63) Continuation-in-part of application No. 13/644,322, filed on Oct. 4, 2012, now Pat. No. 8,863,464.

(51) Int. Cl.

| | |
|---|---|
| ***E04B 5/04*** | (2006.01) |
| ***E04C 2/04*** | (2006.01) |
| ***E04B 2/18*** | (2006.01) |
| ***E04C 5/16*** | (2006.01) |
| ***E04B 2/26*** | (2006.01) |
| *E04B 2/02* | (2006.01) |

(52) U.S. Cl.

CPC ... *E04B 2/18* (2013.01); *E04B 2/26* (2013.01); *E04C 5/16* (2013.01); *E04B 2002/0221* (2013.01)

(58) Field of Classification Search

CPC ..... E04B 2/16; E04B 2/18; E04B 2/46; E04B 2/54; E04B 2002/0234; E04C 1/395; E04C 5/16

USPC ..... 52/603–607, 609, 592.6, 745.1, 747.12, 52/592.5, 596

See application file for complete search history.

(56) References Cited

U.S. PATENT DOCUMENTS

| | | | | | |
|---|---|---|---|---|---|
| 763,945 | A * | 6/1904 | Whitmore | 52/603 | |
| 1,421,986 | A * | 7/1922 | Phillips | 52/375 | |
| 2,001,469 | A * | 5/1935 | Munson | 52/592.4 | |
| 2,201,110 | A * | 5/1940 | Makram | E04B 2/08 | 52/566 |
| 3,924,056 | A * | 12/1975 | LoCicero | 174/497 | |
| 4,075,808 | A * | 2/1978 | Pearlman | 52/439 | |
| 4,107,894 | A * | 8/1978 | Mullins | 52/592.6 | |
| 5,123,222 | A * | 6/1992 | Guarriello | E04C 2/205 | 52/309.12 |
| 5,459,971 | A * | 10/1995 | Sparkman | 52/426 | |
| 5,567,089 | A * | 10/1996 | Akamine | 405/285 | |
| 5,709,060 | A * | 1/1998 | Vaughan et al. | 52/426 | |
| 5,715,635 | A * | 2/1998 | Sherwood | 52/286 | |
| 5,729,943 | A * | 3/1998 | Cambiuzzi | E04B 2/46 | 52/438 |
| 5,855,102 | A * | 1/1999 | Chang | 52/604 | |
| 6,223,493 | B1 * | 5/2001 | Ruggeri | 52/592.6 | |
| 7,007,436 | B1 * | 3/2006 | Kelley | 52/605 | |
| 8,074,419 | B1 * | 12/2011 | Humphress et al. | 52/607 | |
| 2002/0152710 | A1 * | 10/2002 | Guibert et al. | 52/604 | |
| 2003/0079432 | A1 * | 5/2003 | Azar | 52/604 | |
| 2009/0193740 | A1 * | 8/2009 | Bennett | E04C 1/40 | 52/309.1 |
| 2012/0031031 | A1 * | 2/2012 | Rulon | 52/503 | |

* cited by examiner

*Primary Examiner* — Brian Mattei

(74) *Attorney, Agent, or Firm* — Ashley Law Firm P.C.; Stephen S. Ashley, Jr.

(57) ABSTRACT

A multi-purpose interlocking masonry unit includes support members extending from its lower surface and port depressions formed in its upper surface. Each masonry unit can be placed on top of a previously placed masonry unit. The interlocking masonry unit allows for the rapid creation of a wall that is substantially straight and aligned while minimizing the need to perform precise measurements and make alignment adjustments during the creation process. Bonding material can be poured through the resultant wall ports, creating a matrix pattern of bonding material throughout the wall, which results in a stronger more durable construction.

16 Claims, 11 Drawing Sheets

INTERLOCKING MASONRY UNIT

CROSS REFERENCE TO RELATED APPLICATIONS

This application is a continuation-in-part of patent application Ser. No. 13/644,322, filed Oct. 4, 2012, which is now U.S. Pat. No. 8,863,464 and incorporated herein.

FIELD OF THE INVENTION

The present invention relates to an interlocking masonry unit. One embodiment of the invention comprises an interlocking masonry unit for use in mortared or similar wall construction which reduces the need for constant measurements and alignment, resulting in a wall with increased strength.

BACKGROUND OF THE INVENTION

The creation of buildings by utilizing walls made of concrete or similar stonework is a popular method of construction. Many traditional masonry walls are created using masonry units commonly referred to as cinder blocks. A cinder block is a masonry unit in the shape of a rectangular prism with two vertical chambers. A wall is constructed by creating successive rows of cinder blocks. Often each row of cinder blocks is offset by half a block from the previous row to increase stability. Some form of mortar or similar bonding material is placed between each row of blocks to bond the blocks into a solid structure.

One of the primary difficulties of creating cinder block walls is that constant measurements and adjustments must be made as the construction process is undertaken. Bonding material must be laboriously applied between each new block and all adjacent blocks. The craftsman must constantly adjust the wall as each block is placed to ensure that each row is level and straight. Failure to make constant adjustments often results in a wall that is uneven, non-level, angular, or otherwise unstable and not ascetically pleasing. This process is both time consuming for the craftsman and subject to significant human error. The resulting wall is also only as strong as the weakest bonded joint between two adjacent blocks.

Accordingly, there is a need for an interlocking masonry unit. The interlocking masonry unit should connect with adjacent masonry units in a standard way that reduces the need for precision and skill. The interlocking masonry unit should also be designed to accept bonding material that is poured into the wall after each course of the wall is completed in order to reduce overall construction time. The interlocking masonry unit should also be designed to allow the bonding material to pour inside of and between the masonry units in both the horizontal and vertical dimensions to create a strong wall that is bonded together internally in all directions forming a matrix. Furthermore, other desirable features and characteristics of the present invention will become apparent when this background of the invention is read in conjunction with the subsequent detailed description of the invention, appended claims, and the accompanying drawings.

SUMMARY OF INVENTION

An object of the present invention is to provide an interlocking masonry unit that can overcome the aforementioned deficiencies. One embodiment of the invention comprises an interlocking masonry unit that can be placed in connection with an adjacent masonry unit in a standard manner that reduces the need for constant measurement and adjustment for alignment purposes. Bonding material can be poured as the wall is created so that the need for adjustment is clear to the craftsman before the units become permanently bonded together. The interlocking masonry unit can include both horizontal and vertical cavities to accept bonding material in order to create a matrix of bonding material to increase the overall strength of the wall.

BRIEF DESCRIPTION OF THE DRAWINGS

The drawings contained herein illustrate embodiments of the invention. The invention is not limited to the particular embodiments shown in the drawings. The embodiments shown are examples, and the invention is capable of many variations of said embodiment in the drawings;

FIG. 5 also shows the use and placement of rebar reinforcement in the wall system for added strength.

DETAILED DESCRIPTION OF INVENTION

Figure 1:
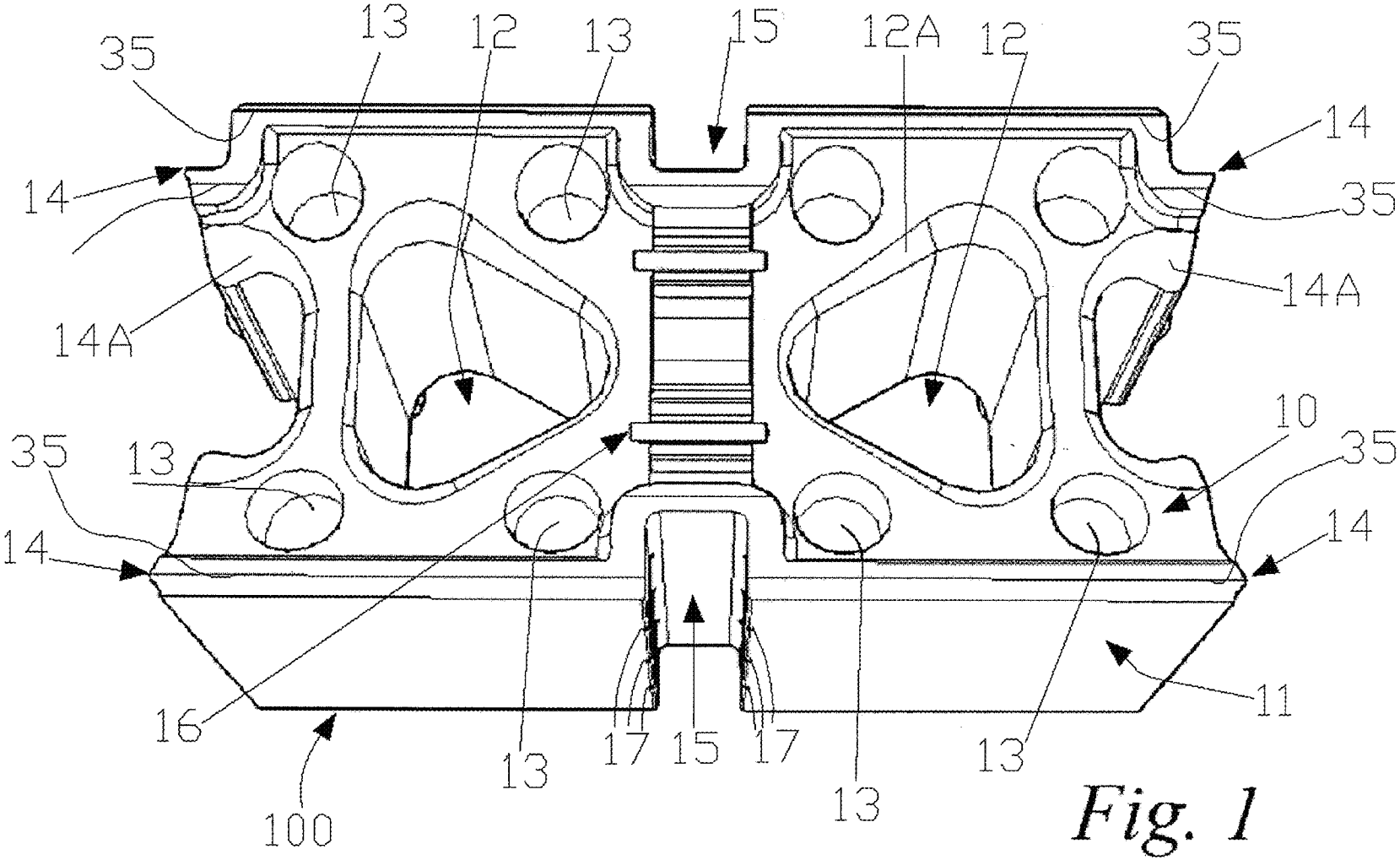
FIG. 1 illustrates a perspective view of the concave upper surface and a side surface of an interlocking masonry unit according to an embodiment of the present invention.
Figure 2:
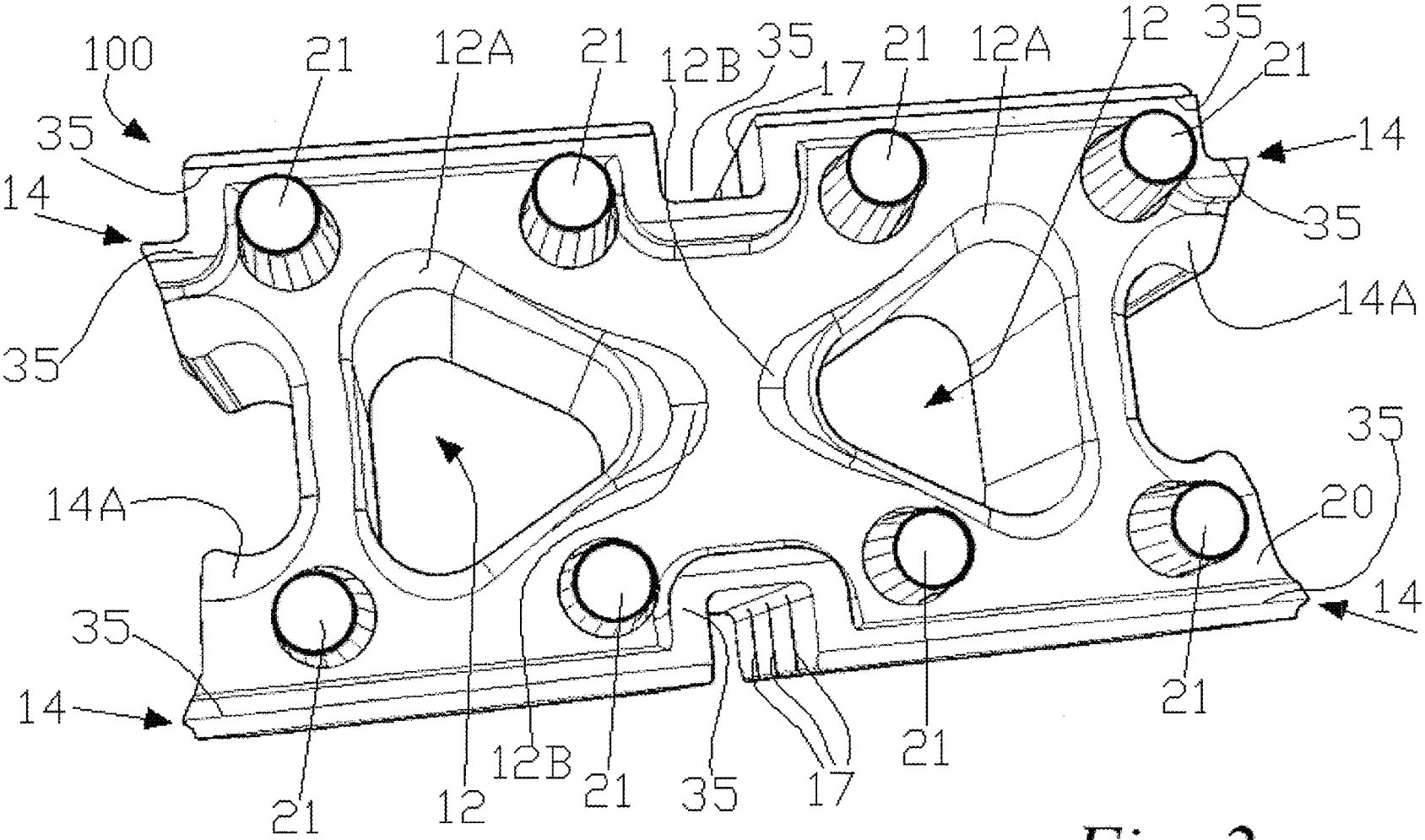
FIG. 2 illustrates a perspective view of the concave lower surface of the interlocking masonry unit of FIG. 1.
Figure 3:
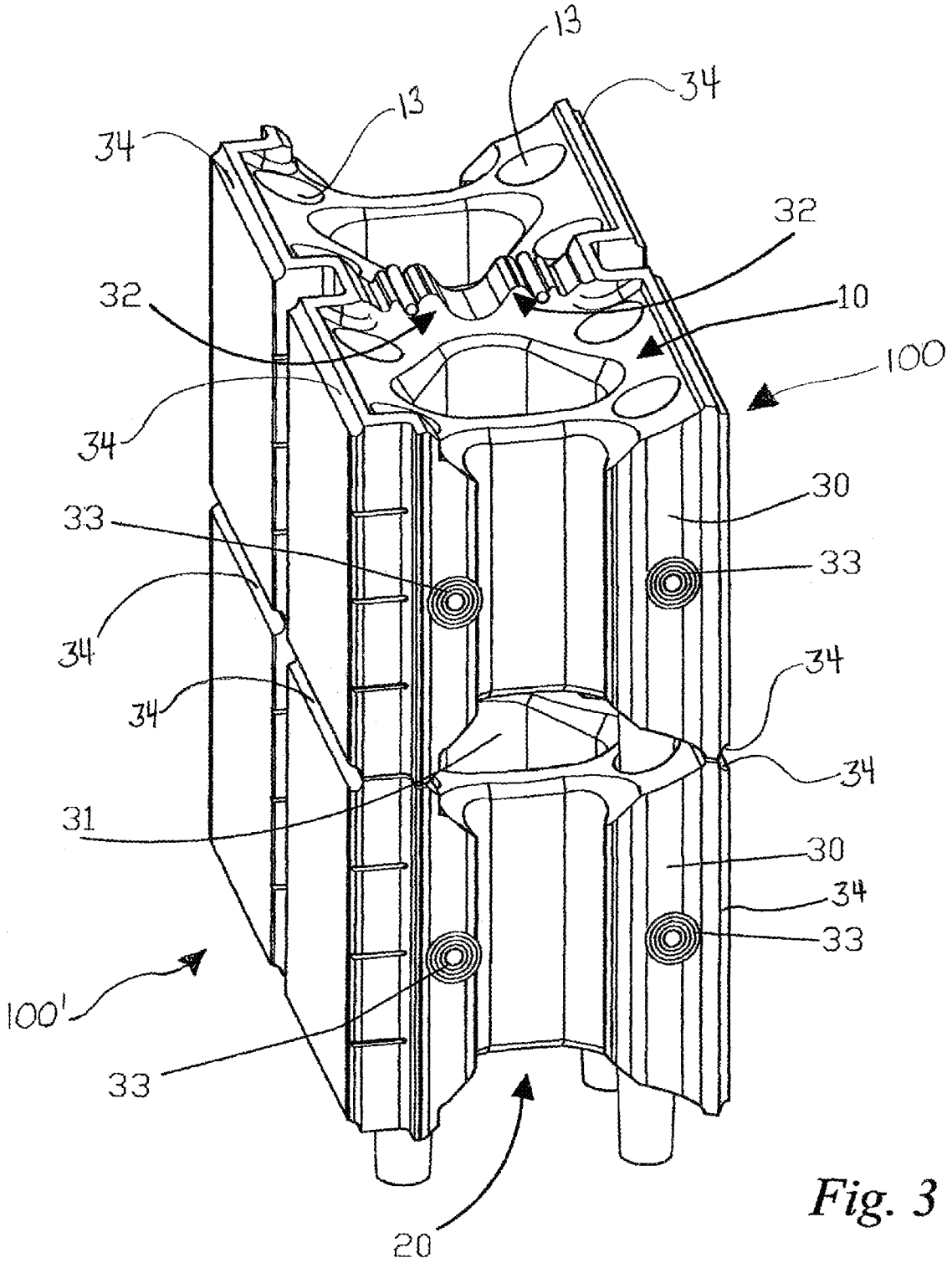
FIG. 3 illustrates an end plan view of two vertically adjacent interlocking masonry units according to an embodiment of the present invention. The masonry unit may be offset by one half block as desired to increase the strength and stability of a stack or wall.

An interlocking masonry unit according to a preferred embodiment of the invention is illustrated in FIGS. 1 and 2, and is shown generally at reference numeral 100. FIG. 1 illustrates a perspective view of the concave upper surface and a side surface of the masonry unit 100. The masonry unit 100 comprises a generally rectangular prism shape with a concave upper surface 10 as shown in FIG. 1. a concave lower surface 20 as shown in FIG. 2, two side surfaces 11 as shown in FIG. 1, and two end surfaces 30 as shown in FIG. 3. The masonry unit 100 can be made of traditional masonry material, such as concrete. Alternatively, the masonry unit 100 can be made of foam. One skilled in the art will recognize that any three dimensional object with a rectangular prism shape generally comprises six surfaces. The surface names, as used throughout the application, are chosen for purposes of designation rather than functionality and should not be considered limiting. The purpose of the concave shape of the upper surface 10 and lower surface 20 is discussed below in reference to FIG. 3.

The masonry unit 100 comprises one or more central vertical cavities 12, as shown in FIGS. 1 and 2. The central vertical cavities 12 should extend between the lower surface 20 and the upper surface 10 of the present invention and should be capable of accepting bonding material. In the preferred embodiment, two central vertical cavities 12 are employed, and each of the central vertical cavities 12 comprise the same shape mirrored about an axis passing through the center of the unit and perpendicular to the side surfaces 11. In the preferred embodiment, the central vertical cavities 12 comprise a rounded triangular shape, however, many central vertical cavity 12 shapes could be substituted. When two or more interlocking masonry units 100, 100' are placed in a vertically adjacent position relative to one another, also referred to hereinafter as a stack as shown in FIG. 3, the central vertical cavities 12 of each masonry unit should be generally aligned with the central vertical cavities 12 of the other units. So long as the central vertical cavities 12 of each unit are generally the same shape and are generally aligned, any bonding material poured into a central vertical cavity 12 of the uppermost unit 100 will also pour through the corresponding central vertical cavity 12 of each unit below in the stack due to the force of gravity. This allows a craftsman to quickly create a wall by stacking the masonry units, one on top of one another, and then pouring bonding material through each vertical cavity as the wall is completed and judged to be in the proper shape and alignment. In the preferred embodiment, the central vertical cavities 12 are surrounded by a sloped edge 12A as shown in FIGS. 1 and 2, preferably at or near a forty five degree angle from the horizontal plane, to act as a funnel creating a larger void between the upper and lower masonry units, thus assisting the bonding material in its movement into the lower portions of the stack.

As shown in FIG. 2, the masonry unit 100 comprises a plurality of support members 21 projecting vertically out from the lower surface 20 of the masonry unit. Preferably, eight support members 21 are employed, however, a greater or fewer number of support members 21 can be employed. As shown in FIG. 1, the masonry unit comprises a plurality of receiving port depressions 13 each projecting vertically into the upper surface 10 of the masonry unit 100. Preferably, eight receiving port depressions 13 are employed. Each receiving port depression 13 can be shaped and positioned to be capable of receiving a corresponding support member 21 from another masonry unit. As such, multiple masonry units can be stacked one on top of another. When creating the stack, the support members 21 of the upper masonry unit are received by the receiving port depressions 13 on the upper surface 10 of the masonry unit immediately below it. In this manner, each masonry unit is effectively interlocked into position relative to the masonry units below. Absent manufacturing defects or variable terrain, the resulting stack is straight and level without requiring the user to undertake efforts to adjust or otherwise level the stack. As variable terrain and manufacturing irregularities are possible, the user can rapidly create a stack and quickly observe and correct any alignment concerns prior to pouring bonding material through the vertical cavities. Preferably, each receiving port depression 13 is larger than the support members 21 to allow the user to make minor adjustments to the wall as it is completed.

Figure 4:
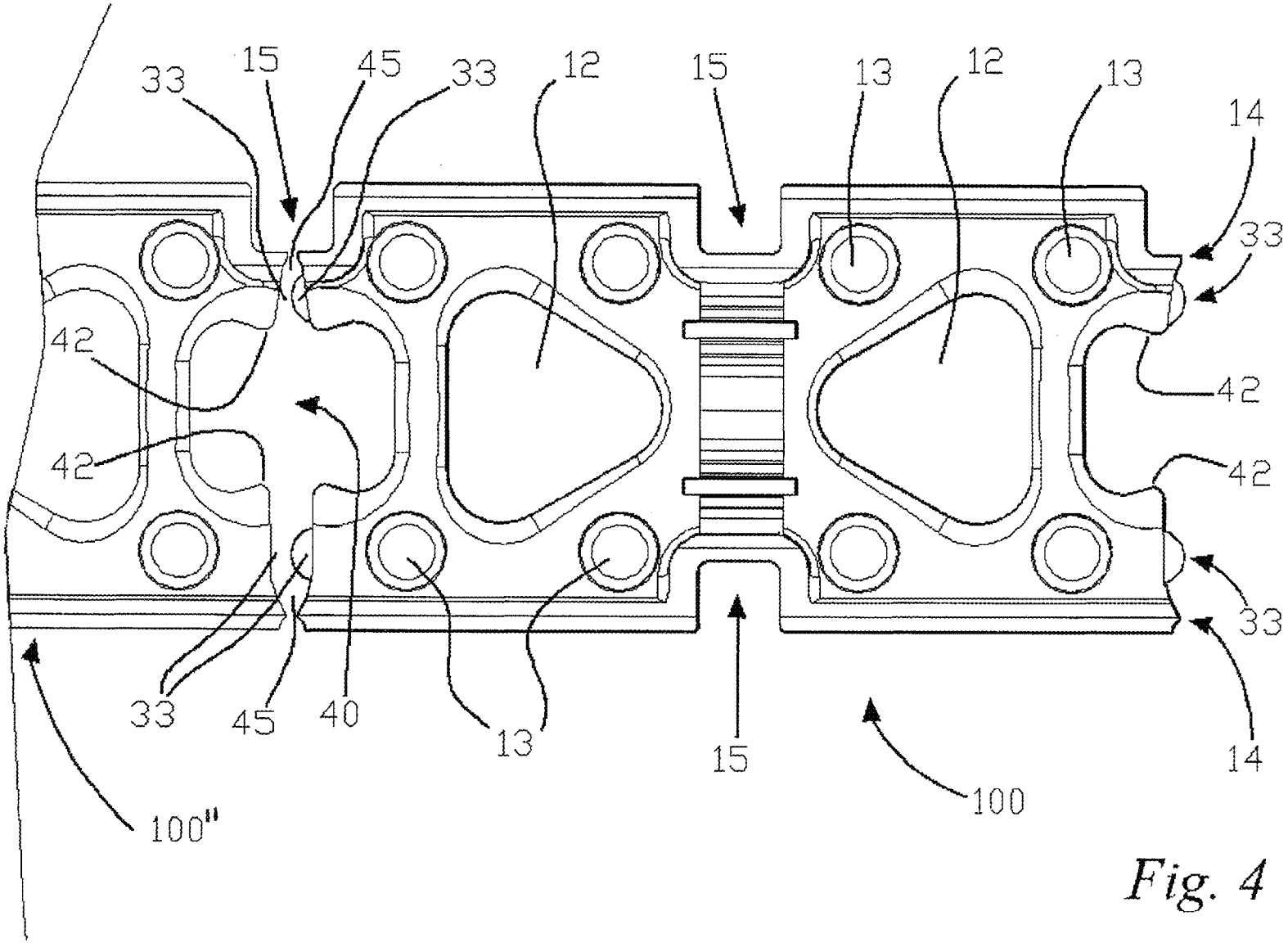
FIG. 4 illustrates a top plan view of a complete and a partial horizontally adjacent interlocking masonry unit according to an embodiment of the present invention.
Figure 5:
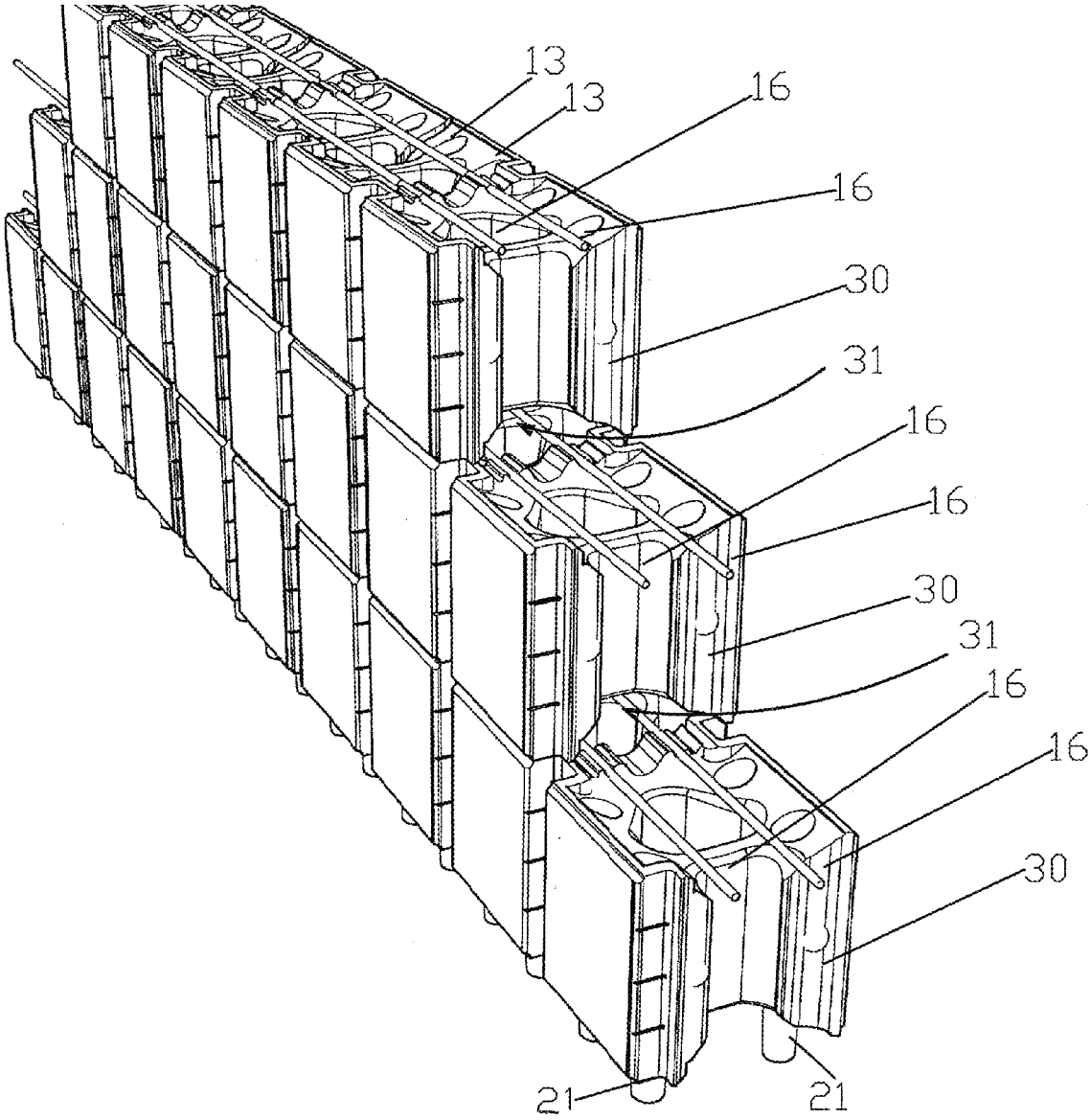
FIG. 5 illustrates perspective view of a wall comprising multiple masonry units according to an embodiment of the invention.

In a preferred embodiment, each end surface 30 as shown in FIG. 3 further comprises two end projections 14. As shown in FIG. 4. the end projections 14 can be shaped and positioned so that when two interlocking masonry units are placed in a horizontally adjacent configuration, an intermediate vertical cavity 40, as shown in FIG. 4, extending between the masonry units is created. When the masonry units are stacked in rows, the intermediate vertical cavity 40 can accept bonding material. So long as the masonry units are not offset, the bonding material can be capable of poured through an intermediate vertical cavity 40, as shown in FIG. 5, that is placed in a higher position in the stack to intermediate vertical cavities 40 that are placed lower in the stack due to the force of gravity. However, even in an offset configuration, as can be seen in FIG. 5, the bonding material can be poured into each intermediate vertical cavity 40 from the central cavity 12 above it, due to the shape and positioning of the central cavities 12. Each of the end projections 14 include a sloped edge 14A, as shown in FIG. 1, preferably at or near a forty five degree angle from the horizontal plane, to act as a funnel and assist the bonding material in its movement into the lower portions of the stack. The end projections 14 should be omitted on the end surface 30 of any masonry unit that is to be used at the corner of a wall. It should also be noted that, in the preferred embodiment, portions of each block end come in contact with an adjacent block. This allows for proper alignment and spacing which maximizes amount of bonding material to attach between each unit to strengthen the bond. It should also be noted that, preferably, the shape of the intermediate vertical cavity 40 is irregular. This configuration increases the surface area available for the bonding material to attach to for a stronger bond. This configuration also ensures that the end projections 14 each attach around the cured bonding material contained in the vertical cavity 40, which further reduces the possibility of a breach in the wall, even if the bonding material should become separated from the associated masonry unit.

As shown in FIGS. 1 and 4, the masonry unit 100 can include one or more vertical depressions 15 in one or both of the side surfaces 11. Preferably, each vertical depression 15 has a width greater than one-half inch and less than two inches. Preferably, each vertical depression 15 projects into the masonry unit 100 between one-half inch and two and a half inches, and each vertical depression 15 also preferably extends down the entire side surface 11 of the masonry unit. When crafted to these preferred dimensions, each vertical depression 15 is capable of accepting a wall stud. The vertical depressions can further comprise a plurality of stud support notches 17, as shown in FIGS. 1 and 2. Each of the stud support notches 17 can be capable of accepting a peg to hold a wall stud in place. When a wall is finalized, a wall stud can be inserted into the vertical depression 15 and secured in position by means of plurality of pegs or similar items hammered or screwed into the stud support notches 17. In an alternate embodiment, no support notches 17 are provided and the wall studs can be secured by a toggle bolt or other securing means. This allows the user to create a wooden wall, capable of accepting drywall or similar finishing material without the structure that is typically associated with a standard wall. Referring to FIG. 4, the end projections 14 may also be shaped and positioned to create a vertical depression 15 in the side surface 11 between two horizontally adjacent interlocking masonry units 100, 100' that are capable of accepting a wall stud. This ensures that in the case of stacked rows where one or more rows are offset by half a masonry unit from one another, the vertical depression 15 in the side surface 11 of a masonry unit lines up with the vertical depression 15 created between two horizontally adjacent masonry units on a different row. This allows a wall stud to be accepted into all of the rows at once. Preferably, the vertical depressions 15 are positioned to create a distance of eight inches between the center of each wall stud and the center of the horizontally adjacent wall studs, once said wall studs are accepted. This allows the user to easily attach standard building materials to the wall studs.

FIG. 3 illustrates an end plan view of two vertically adjacent interlocking masonry units 100, 100'. In the preferred embodiment, the concave upper surface 10 of the lower masonry unit and the concave lower surface 20 of the upper masonry are shaped to create a horizontal cavity 31 which extends between the two masonry units. The horizontal cavity 31 is capable of accepting bonding material poured from upper rows through the vertical cavities and channeling the bonding material horizontally between two rows in the wall. The channel created by the horizontal cavity 31 and the vertical cavities 12 create a matrix of cured bonding material which increases the overall strength of the wall in relation to standard cinderblock walls. The channel created by the horizontal cavity 31 also allows bonding material to pour into the intermediate vertical cavities 40 in cases where the rows of the wall are offset. An end surface 30 of any masonry unit that is to be used at the corner of a wall can include an additional projection on the upper surface 10 and the lower surface 20 capable of closing the horizontal cavity 31 and vertical cavity 40 preventing any bonding material from escaping from the channel created by the horizontal cavities 31 of the masonry units 100, 100' in the wall.

In a preferred embodiment, the upper surface 10 further comprises a plurality of upper projections 32 as shown in FIG. 3. The upper projections 32 can accept one or more reinforcing elements 16, as shown in FIG. 1 and FIG. 5, such as concrete reinforcing bar, also known as rebar, and/or similar items. The vertical channels created by the central vertical cavities 12 are also capable of accepting one or more reinforcing elements 16. The presence of the reinforcing elements 16 increases the overall structural integrity of the resultant wall after the bonding material is poured inside and allowed to cure. The matrix of vertical and horizontal channels associated with a wall constructed with the interlocking masonry units, as described herein, along with associated reinforcing elements 16, creates a structural integrity that is significantly increased over a standard cinder block wall.

Figure 8:
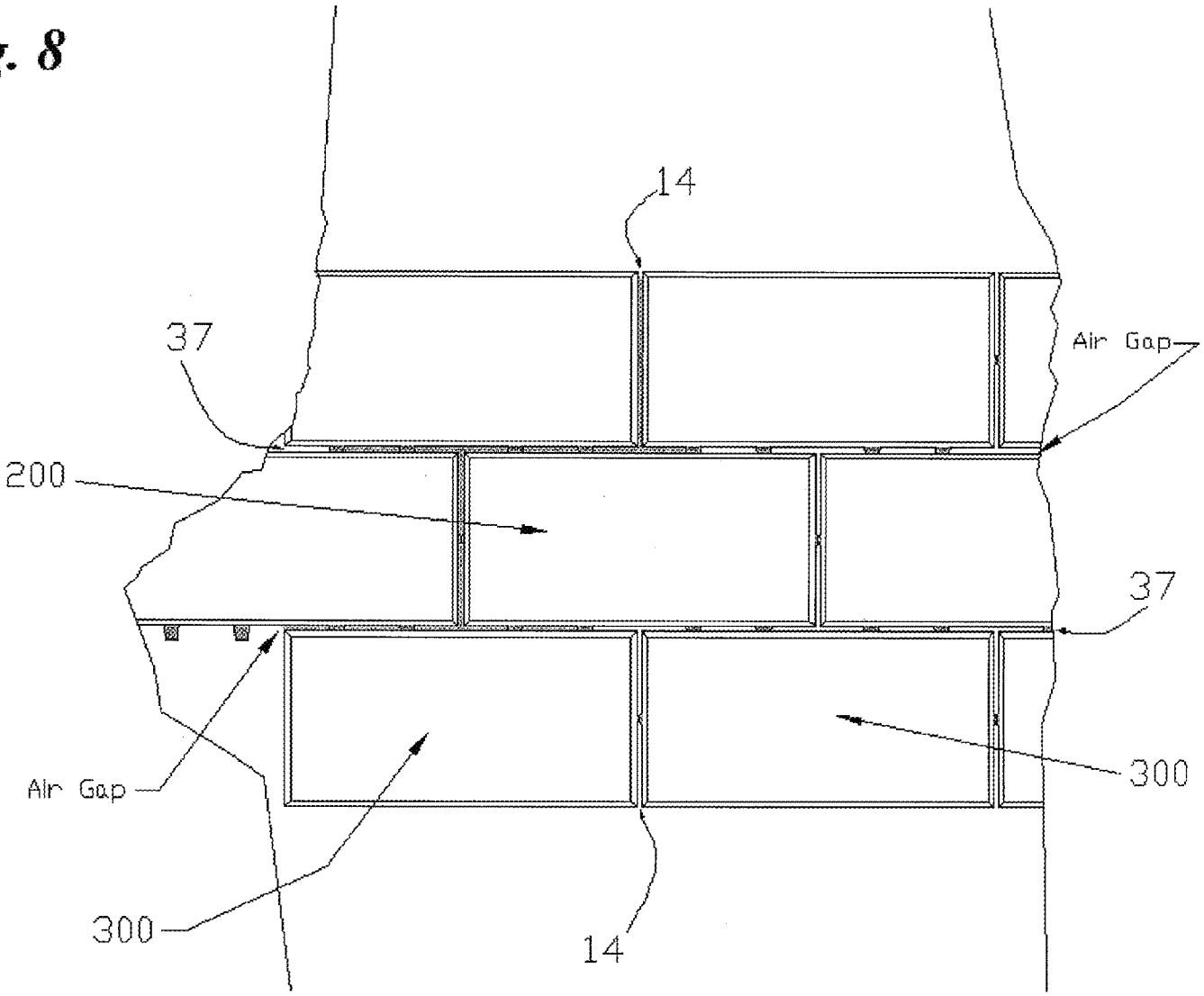
FIG. 8 illustrates a front elevation of a wall comprised of a plurality of interlocking masonry units according to an embodiment of the invention.

In a preferred embodiment, the masonry unit 100 has sharp edges 14, 35 at the outer perimeter at the top and bottom and on both ends of the masonry unit 100, as shown in FIGS. 1 and 2. The sharp edges 14, 35 form one-half of a mortar seam. The edges 14, 35 slope inward, toward the center of the masonry unit 100 to form a "V" or pinch point 37, 45, as shown in FIGS. 3B, 4 and 8, between masonry units 100, 100", when the units are stacked end to end and/or one on top of the other. The pinch points 37, 45 preferably should be approximately one-sixteenth to one eighth inch in width. The pinch points 37, 45 are shaped similar to a funnel to guide the bonding material from a wide area or space to the narrow space where the grit, sand and gravel of the bonding material fill in, forcing out air from the masonry units and sealing the space, bonding the units together. In addition, the masonry unit 100 can have sloped, concave outer edges 34, as shown in FIG. 3.

In a preferred embodiment, each end projection 14 further comprises a bumper projection 33. As can be seen in FIG. 4, each bumper projection 33 is shaped and positioned to come in contact with a bumper projection 33 of an equivalent horizontally adjacent interlocking masonry unit when the masonry units are being placed by the user. In this manner, the user may place each masonry unit, verify the bumper projections 33 of each masonry unit are properly touching, and thereby verify that the row of masonry units being created is level and aligned. The bumper projections 33 hold the blocks of the masonry units apart a pre-determined distance, as shown at reference numeral 45 in FIG. 4. Preferably, the bumper projections 33 create a space 45 of approximately one-sixteenth to one-eighth inch wide. This space 45 lets the air out when the masonry units are being filled with bonding material. The grit, rock and sand that is part of the bonding material fills the internal block voids are stopped from exiting at this point FIG. 5 illustrates a perspective view of a wall comprising multiple masonry units according to a preferred embodiment of the invention. A method of assembling a wall comprising interlocking masonry units as depicted in FIG. 5 is now more fully described. A row of interlocking masonry units can be created by placing a plurality of interlocking masonry units on a prepared surface in a manner that causes the end surface 33 of each masonry unit to come in contact with an end surface 33 of one or more adjacent masonry units. Subsequent rows of interlocking masonry units can be positioned on top of the previously created row of interlocking masonry units by placing the support members 21 of the masonry units in the subsequent row into the receiving port depressions 13 of the previously placed row. This process can be repeated until a wall or structure of the desired height is created. Reinforcing elements 16 can be placed into the horizontal cavities 31 between each row. Depending on the embodiment, the user may shift each subsequent row by half of the length of a masonry unit in the horizontal axis from the previously placed row to increase the stability of the resultant wall. The reinforcing elements 16 can be placed in the horizontal cavities 31 prior to placing any associated corner units. Reinforcing elements 16 should also be placed into the central vertical cavities 12 and 40 of each masonry unit for greater structural integrity. Bonding material can be poured into the vertical cavities and allowed to spread and seep into the horizontal cavities to create a matrix of bonding material throughout the cavities of the wall. A mechanical means may be employed to vibrate and to assist the bonding material in its spread throughout the matrix of cavities in the structure. The bonding material should then be allowed to cure in the wall. In an alternate embodiment, bonding material can be poured into the cavities after each row is positioned.

The support members 21 can serve a number of purposes. The support members 21 can align the upper block 200 and the lower block 300 with each other. Also, the support members 21 lift or hold the block 200 above the lower block 300, as shown in FIG. 8. Preferably, the support members 21 are about 1/16 to 1/8 inch longer than the members 21 would be when positioned in the port depressions to align the upper block 200 and lower block 300 the outer horizontal sides or edges to sit flat or flush against each other. The support members 21 keep the block 200 raised off the outer edges of the block 300 below it creating an air gap 37, shown in FIG. 8, between the upper block 200 and the lower block 300, as shown in FIG. 8. The outer edge of the upper block and lower block has a molded in mortar seam, as shown in FIG. 3, on each horizontal edge 34 of the block next to or adjourning the horizontal edge of the block where the molded in mortar seams run horizontally at the back top edge. Starting from the top front edge of the mortar joints or seam, this is where the gap 37 is formed and mortar fills the gap between the blocks to seal and bond the blocks together. The surfaces of the back top edge begin to slope or taper off inward to the concave surface. This sloping edge runs the horizontal length of the block, and the inward sloping mortar joint goes around the outer edge of the vertical cavities 15, as shown in FIG. 1.

This inward sloping taper of the back of the mortar joint or seam can be on both edges of the block, top and bottom. When the top block support members 21 are positioned in the bottom block port depressions, the horizontal edges between the two blocks are separated by a space or an air gap by approximately 1/16 to 1/8 of an inch. This space has the purpose of exhausting of the air as the block is filled with bonding material. The support members 21 hold the blocks apart about 1/16 to 1/8 of an inch support and align the block. The support members 21 holding the blocks apart leave a gap or space between the blocks. When bonding material flows into the vertical cavities 12, 40, bonding materials also flows into the horizontal concave cavities 31 and the blocks become filled with bonding material in vertical cavities 12, 40 and the horizontal concave cavities 31. Bonding material forces air out through this space or air gap between the blocks, filling the space between the blocks with bonding material. The bonding material continues to seep into the space, sealing the space, filling out the mortar seam, surrounding the support members filling the horizontal concave space or voids and the vertical spaces allowed to cure the blocks will not separate without destroying the assembly.

As shown in FIG. 4, an air gap 45 is created vertically between the two blocks end when the blocks are placed in close proximity to one another. The air gap 45 is approximately 1/16 to 1/8 of an inch wide.

The front top edge of the one half mortar seam begins to slope or taper off to the interior. The top edge of the one half mortar seam is a vertical pointed area. When the two blocks with the same pointed area come together they form a pinched point 45 as shown in FIG. 4 (also see reference numeral 37 in FIGS. 3B and 8).

When the ends of two blocks come together and are aligned, and the bumpers or spaces touch properly, the vertical cavity 40 is formed. When the bonding material fills the cavity, it pushes air out through the air gap 45, as shown in FIG. 4, since the opening forming the air gap tapers down to 1/16 to 1/8 of an inch between the two half mortar seams. Bonding material cannot go through the gap 45. The bonding material bonds and seals the air gap 45 creating a finished mortar seam or joint. As shown in FIG. 4, the block ends are kept apart by the bumper 33 or spaces located on each end. The purpose of the bumpers 33 or spaces is to keep the blocks the proper space or distance apart so that no other part of the block touches the other. The bumper or spacers touch at a predetermined point at its outer edge. This keeps the blocks properly spaced apart and aligned with the other block so that there is an air gap 45, shown in FIG. 4, at the vertical ends of the block.

The vertical channels 12, 40, shown in FIG. 4, increase the flow of bonding material between both blocks when the blocks are offset. An extra wide void 31, shown in FIG. 3, is created in the concave horizontal design of the block. The concave is extra wide and deep to increase the bonding flow and more adhesive surfaces. The void is concave on the upper blocks, lower or bottom surface, and concave on the lower blocks upper surface. The concave surfaces can accomplish several things. The concave surfaces open up or increase the open space or void between the upper and lower blocks, increase the amount of surface area the bonding material can attach to and increases the ease whereby the bonding material can flow between blocks to fill open spaces or voids, and increase or enhance the flow of bonding material over or through the vertical cavities 12.

Figure 3A:
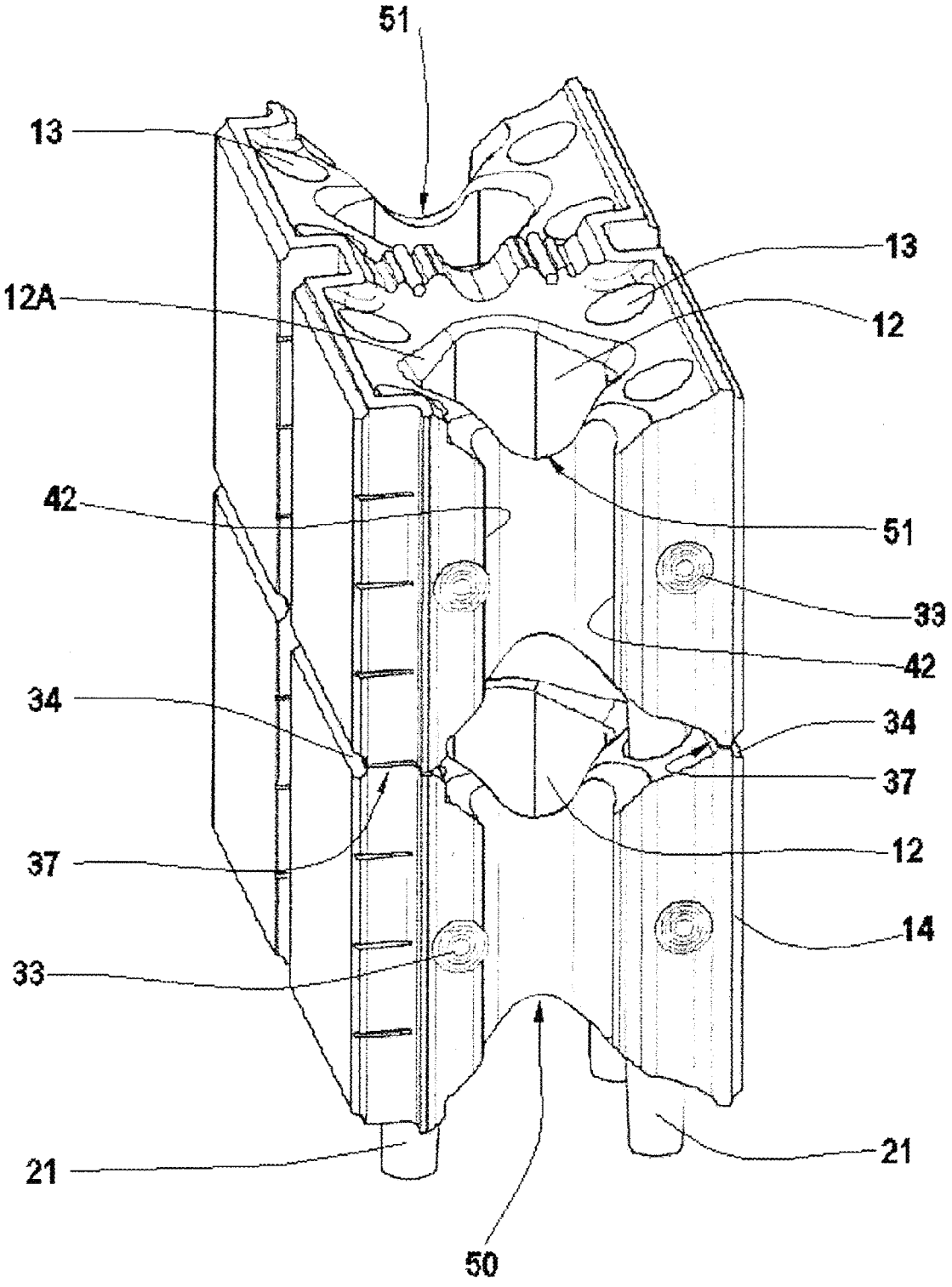
FIG. 3A illustrates an end plan view of two vertically adjacent interlocking masonry units according to another embodiment of the present invention.
Figure 3B:
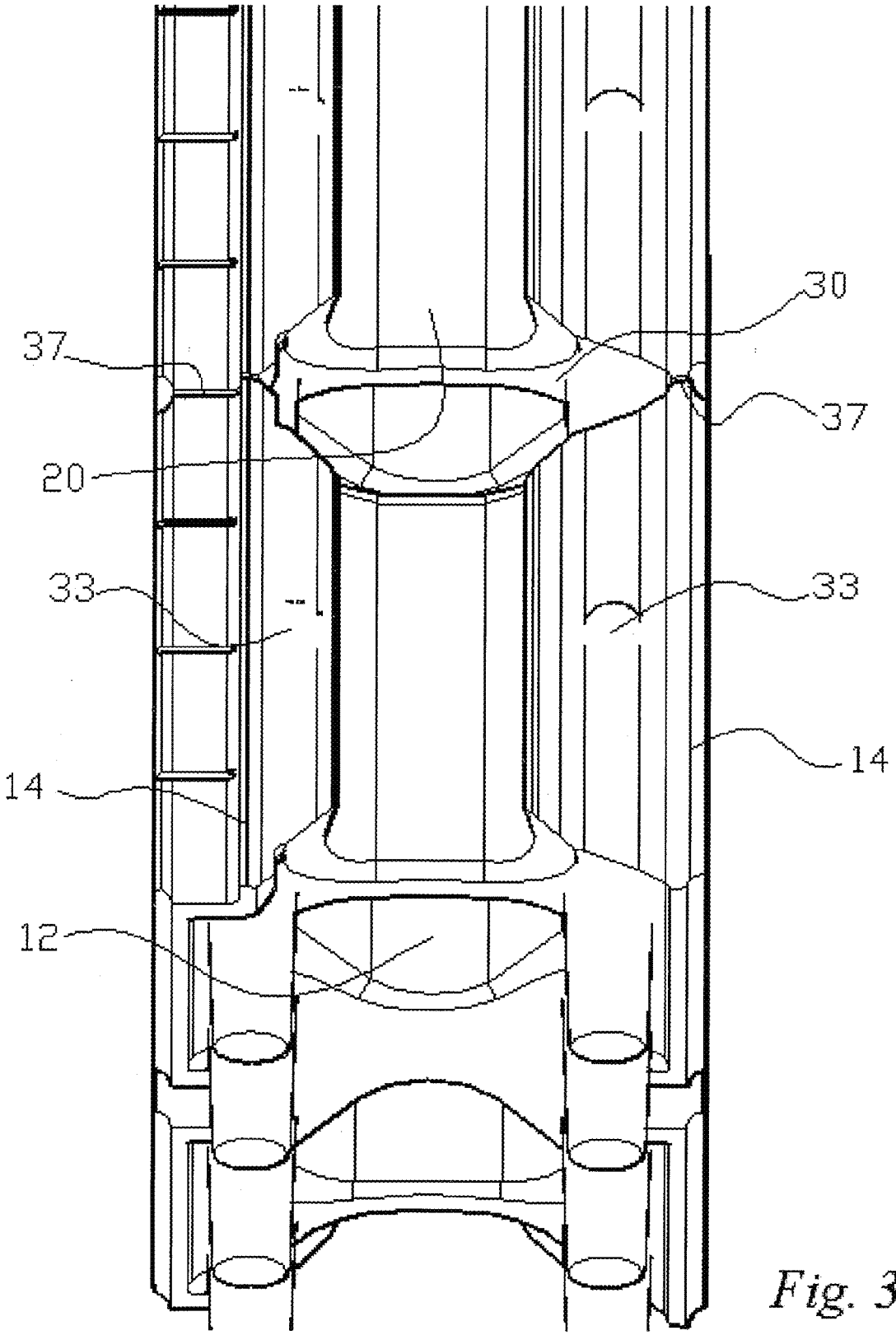
FIG. 3B illustrates another end plan view of the masonry units of FIG. 3A.

The vertical cavities 12, 40 can have angled or sloped top edges 51, as shown in FIG. 3A. The angle or slope on the top edge of the vertical cavities 12, 40 are cut away at an angle of about thirty to forty-five degrees to enhance or increase the flow of the bonding material through the vertical cavities 12,40 and concave spaces and/or voids. The top sloping edges 51 and bottom sloping edges 50 of the vertical cavities 12, 40, of the block add to the overall surface area for bonding material to attach to for added adhesion or bonding surface for added strength of the structure. In addition, the sloping edge forms a locking plug in the vertical cavities so if the bonding materials become detached from the vertical cavities the overlap or lock formed by the cured bonding material lapping over the edge or sloping outward from the vertical cavities 12, shown in FIGS. 1 and 2, lock the plug into the vertical cavities by virtue of the lip or the slope. Therefore, when the wall structure is built the bonding materials form a matrix or lattice in the interior of the block. If a horizontal or vertical force is applied to the wall, the wall resists movement because of the matrix or lattice in the interior cured bonding material and the rebar structure.

The bonding material surrounds all support members 21 to hold them in place. The upper and lower concave areas of the two blocks are bonded together by the bonding materials that fill the connected spaces. The upper and lower blocks are bonded together through the bonding materials in the vertical cavities. The studs in the vertical cavity 15, shown in FIG. 1, help support the wall. The studs can be locked in each block by pegs or similar devices to keep it from moving vertically or horizontally. The lips or slopes (angles) 12A, 14A keep the block from pulling apart vertically.

The introduction of the rebar between the upper and the lower block with their ends tied together adds strength to the matrix of the cured bonding material that runs within the interior of the structure. The bonding material matrix within the block and the vertical rebar in the vertical structure in combination with the two rebar that run across the blocks top center rebar supports 16, 32, shown in FIGS. 1 and 3, add to the durability, strength, and integrity of the structure holding the blocks together both horizontally and vertically.

The point of the vertical triangular cavity 12 points inward between support members 21, as shown in FIG. 2, to extend far enough into the center of the block to be over the opening of the cavity 40. The blocks are offset by one half block for cavity 40 to be fully filled with bonding material, since the opening between cavity 12 and cavity 40 vertically is narrow.

Figure 6:
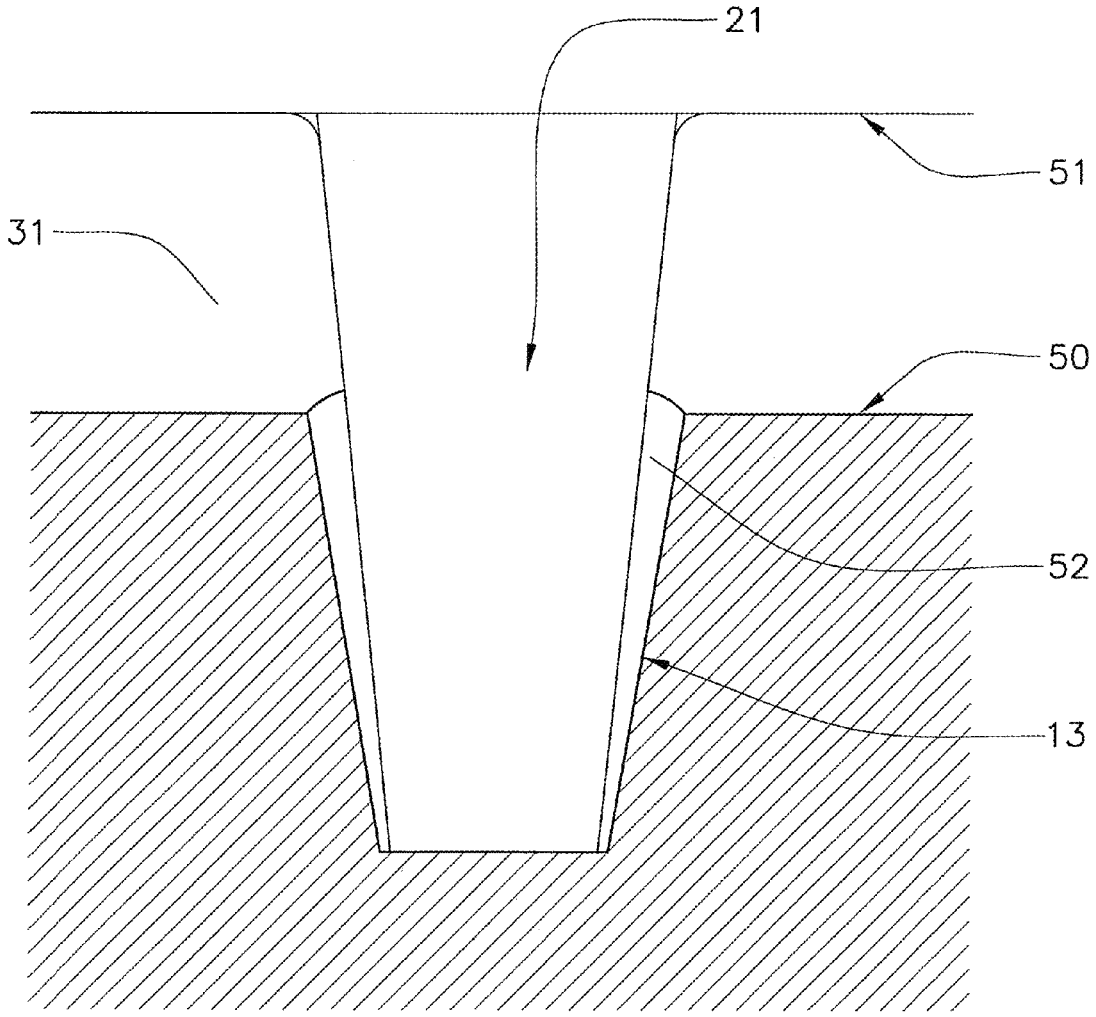
FIG. 6 illustrates a partial cross sectional view of a support member according to an embodiment of the invention.
Figure 7:
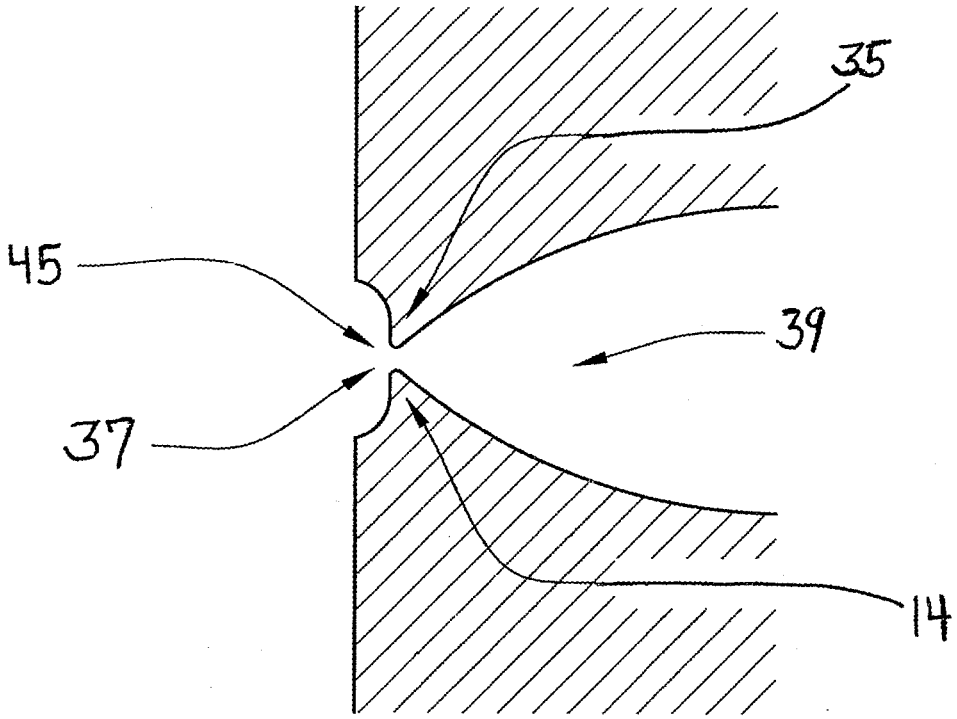
FIG. 7 illustrates a partial cross sectional view of an interlocking masonry unit according to an embodiment of the invention.

So that there are the minimum number of unbonded surfaces within a structure, an air gap 52 can be made around the support member 21, as shown in FIG. 6. As shown in FIG. 6, the support member 21 can be seated loosely, for slight movement in the port depression 13. The upper part of the support member at the concave surface 54 has a large air gap around the support member 21. This air gap allows bonding material to flow down into the port depression along the sides of the support member 21 inside the port depression bonding everything together in the concave surface.

Figure 4A:
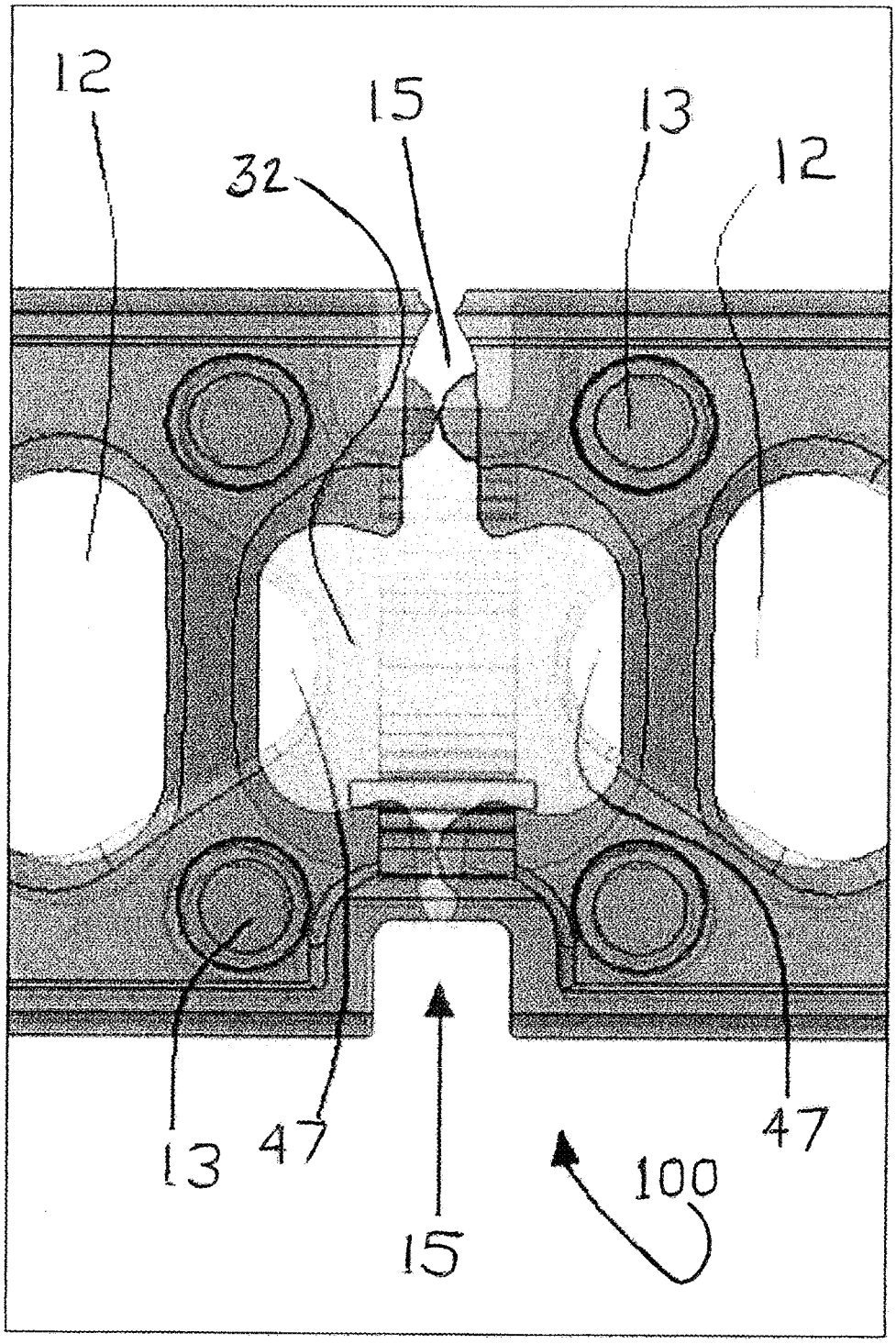
FIG. 4A illustrates a partial bottom plan view of the interlocking masonry unit of FIG. 4.

In order for bonding material to flow more easily into cavity 40, which is below the rebar bridge, when the masonry units are offset by one-half masonry unit, the triangular shaped vertical cavities 12 on both ends of the masonry unit have been cut down or cut away, as shown in FIG. 3A at reference numerals 50 and 51. This feature, in addition to the feature shown in FIG. 2 at reference numeral 12B increases the volume of flow of bonding material below the rebar bridge to cavity 40. FIG. 4A provides a reverse view, in which the shaded area which is normally below the rebar bridge is shown on top for the purpose of showing the limited space between the masonry unit for bonding material to flow into cavity 40 when the rebar bridge is above. The white area shown at reference numeral 47 in FIG. 4A shows the limited opening to the cavity 40 below the rebar bridge area limiting bonding material flow to cavity 40 below.

Filling cavity 40 can be a problem, because of the rebar support bridge. The bridge adds strength to the center of the block and gives the wall integrity. The width of the center of the block and the position of cavities 12 over cavity 40 can make it necessary to use an enhanced triangular shaped vertical cavity with a cutaway section 12B on the bottom of the block, as shown in FIG. 2.

The width between the two support members 21, shown in FIG. 2, where the triangular shape vertical cavity points to the center of the block has limited opening. To overcome the narrowed opening to cavity 40, the triangular shaped cavity is used to extend between support members 21, as shown in FIG. 2 at reference numerals 12, 12B. This creates a larger opening to the vertical cavity 40 below on both sides of the rebar support bridge, shown in FIG. 3 at reference numeral 32. FIG. 4A shows a reverse view with cavity 40 on top for the purpose of showing the limited opening to cavity 40 below the rebar bridge. The cavity 40 is below the rebar bridge 32, shown in FIG. 3, for this purpose. Looking down along both sides of the rebar bridge, only the area 47 (shown in FIG. 4A in white) of cavity 40 can be seen from above the rebar bridge. This shows the narrow opening to cavity 40 below.

As shown in FIG. 2, the concave area between the upper and lower block and the position of the triangular vertical cavity 12 and the cutaway area 12B gives the cavity 40 spanned between the two blocks a wider opening for bonding material to flow through.

The cutaways 12B are widening inward protruding point of the triangular vertical cavity 12, as shown in FIG. 2, enhances the flow of bonding material to vertical cavity 40, as shown in FIG. 4A, which is a reverse overlay. The cutaway are 12B widening and increasing the opening between the cutaway point of the triangular vertical cavity 12 and cutaway 12B on the bottom of the block, opening up the horizontal concave cavity to vertical cavity 40 below.

As shown in FIG. 1, the vertical cavity 15 adds to the overall durability, strength, and integrity of the structure. The two by four or other structure having been locked into the vertical cavities 15 by the peg system resists being pulled out vertically or horizontally, thereby maintaining the structure.

When cavity 40 is over the blocks rebar support, the problem of bonding material flow is lessened by the fact that vertical cavities 12 on either side of cavity 40 has a wide opening to the vertical cavities below the block and can be easily filled. When the rebar support area is offset by one half block vertical cavity 40 opening or passage way between the upper block vertical cavity 12 and the lower block vertical cavity 40 is greatly narrowed.

To overcome the narrow passage way that the bonding material has to go through, the opening should be opened up greatly. To do this, the vertical triangular opening 12, shown in FIG. 2, should be between the support members 21 and pointed inward toward the center of the block. Next, the concave surface on the top of the block and the bottom of the block had to be as deep as possible.

To accommodate the fast flow of the bonding material for maximum opening of the upper and lower block. Next, the edges of the cavities 12 and 40 had to be opened up or widened to create a larger gap between the lower vertical cavity 12 edge of the top block and the top edge of the vertical cavity of the bottom or lower block. To do this, the edges of the vertical opening 12A and 14, shown in FIG. 1, are trimmed back to a thirty to forty-five degree angle or slope. With the sloping edges of the vertical cavities and a distance between 2½ to 3 inches maximum between the upper and the lower concave surfaces bonding flow is increased.

The opening between the upper block vertical cavity 12 and the lower block cavity 40 can be opened up or widened further by cutting away part of the center of the block, as shown in FIG. 2 at reference numeral 12B. The cutaway of the center of the block gives more opening or space between the upper block vertical cavities 12 and the lower vertical cavity 40, thus the bonding material has a greater opening for bonding material to flow through to fill the cavities.

When the blocks are offset by one half block, the rebar support area is shifted to be over the vertical cavity 40, as shown in FIG. 4A. This reduces the opening between vertical cavity 12 and the vertical cavity 40 in the block below.

The triangular shape vertical cavity 12 enhances the flow of bonding material in the vertical cavities 12 and 40. The edges on the concave surfaces of the block can be cut deeply, such as at a thirty to forty-five degree angle as shown in FIGS. 1 and 2 at reference numerals 12A, 14A. The lip or slope of the edge of the cavities on the top concave surface and the bottom concave surface prevent the cured bonding material from pulling out.

The triangular shape of the vertical cavities should be pointed inward toward the center of the block to be able to reach in far enough to be over cavity 40, as shown in FIG. 4A at reference numeral 47. FIG. 4A provides a reverse image with cavity 40 on top of the rebar area, and area 47 (shown in white in FIG. 4A) being the opening to the cavity 40 below. FIG. 4A shows cavity 40 on top to illustrate the narrow opening to vertical cavity 12.

An extended area of the lip or slope inward to the center of the block area can be cutaway, as shown in FIG. 2 at reference numeral 12B. This area opens up or widens the distance or space between vertical cavities 40 and the cavity 12 and area 12B. This cutaway area 12B gives the bonding material a bigger opening to flow through. Also, the triangular shape gives the vertical cavity 12 a wider opening in the concave cavity, as shown in FIG. 2. The outer edges of the triangular shape and sloping lip extended between and beyond the mounting area of the support members 21 gives the horizontal cavity a wider opening in the concave cavity for bonding material to flow through to cavity 40. The interior of the vertical cavities 12 can have rounded corners or points, since sharp angles have a greater tendency to crack or break. The maximum amount of material has been removed from the block without sacrificing the structural integrity of the block. As such, the area for the bonding material to attach to is maximized, thereby making the block lighter and minimizing the amount of material needed in the manufacturing process.

When two block ends come together, each forms one half of the vertical cavity 40, as shown in FIG. 4. The end vertical cavity of a block is one half part of vertical cavity 40, and has a locking design in that the horizontal opening is narrower, as shown in FIG. 4 at reference numeral 42, than the back side open vertical area. The cavity 40 includes an area 14A on the upper and lower lip or edges of the vertical cavities 40. When the end of the two blocks are placed together, as shown in FIG. 4, and bonding material fills the area and is allowed to cure, the blocks become inseparable. The cured bonding material cannot pull out vertically, because the bonding material overlaps the slope of area 14A, as shown in FIG. 1. Also, the bonding material cannot pullout of the vertical cavity 40, because it is locked in the vertical cavity 40 by the vertical lip and narrow opening, as shown in FIG. 4 at reference numeral 42.

While the present invention has been described above in terms of specific embodiments, it is to be understood that the invention is not limited to the embodiments described above. Various modifications and other embodiments can be made without departing from the scope of the present invention. The foregoing description of various embodiments of the invention and the best mode for practicing the invention are provided for the purpose of illustration only and not for the purpose of limitation—the invention being defined by the following claims and equivalents thereof.

What is claimed is:

1. A masonry apparatus comprised of a first interlocking masonry unit comprising:

(a) a body comprising a concave lower surface, a concave upper surface and at least one side wall intermediate the lower surface and the upper surface;

(b) at least one central vertical cavity extending between the concave lower surface and the concave upper surface and capable of accepting bonding material, the at least one central vertical cavity including a cut away section forming a recess in the at least one side wall;

(c) a plurality of support members projecting substantially vertically from the concave lower surface; and (d) a plurality of receiving port depressions formed in the concave upper surface, wherein each receiving port depression is shaped and positioned for receiving a support member of a second interlocking masonry unit.

2. The masonry apparatus of claim 1, wherein the support members elevate the body above the second interlocking unit to form a mortar seam air gap between the first interlocking masonry unit and the second interlocking masonry unit.

3. The masonry apparatus of claim 1, wherein the at least one central vertical cavity has a substantially triangular shape to facilitate the flow of bonding material into the cavity.

4. The masonry apparatus of claim 1, wherein a vertically oriented air gap is formed between the first masonry unit and the second masonry unit when the units are horizontally adjacent, whereby bonding material can flow into the air gap and form a mortar seam.

5. The masonry apparatus of claim 1, wherein the at least one central vertical cavity has a sloping edge forming a locking plug.

6. The interlocking masonry unit of claim 1, wherein the concave upper surface and the concave lower surface are shaped to create a horizontal cavity extending between said masonry unit and an equivalent vertically adjacent interlocking masonry unit, said cavity being capable of accepting bonding material.

7. The interlocking masonry unit of claim 6, wherein the first and second opposite end surfaces each comprise two end projections shaped and positioned to create an intermediate vertical cavity extending between said masonry unit and an equivalent horizontally adjacent interlocking masonry unit, said cavity being capable of accepting bonding material.

8. The interlocking masonry unit of claim 7, wherein the end projections of the end surfaces are shaped and positioned to attach around cured bonding material contained by the intermediate vertical cavity.

9. The interlocking masonry unit of claim 7, wherein the intermediate vertical cavity comprises a sloped edge.

10. The interlocking masonry unit of claim 7, wherein the end projections of the end surfaces are shaped and positioned to create a vertical depression in a side surface between said masonry unit and an equivalent horizontally adjacent interlocking masonry unit, said vertical depression being capable of accepting a wall stud.

11. The interlocking masonry unit of claim 7, wherein the end projections further comprise bumper projections shaped and positioned to come in contact with the bumper projections of an equivalent horizontally adjacent interlocking masonry unit.

12. The interlocking masonry unit of claim 1, wherein each of the plurality of receiving port depressions is substantially frusto-conical, and includes a top opening at the upper surface of the body and a base below the upper surface of the body, the top opening having a diameter greater than a diameter of the base.

13. An interlocking masonry unit comprising:

a body comprising a concave lower surface, a concave upper surface, and a side wall intermediate the concave lower surface and the concave upper surface, at least one central vertical cavity extending between the concave lower surface and the concave upper surface and capable of accepting bonding material, at least one support member projecting vertically out from the concave lower surface, and at least one receiving port depression projecting vertically into the concave upper surface adapted for receiving a support member of an equivalent vertically adjacent interlocking masonry unit, the at least one port depression having a substantially frusto-conical shape.

14. The interlocking masonry unit of claim 13, wherein the body has a substantially rectangular prism shape, and the side wall comprises two side surfaces, and two end surfaces, and the body includes at least eight inwardly sloped outer edges.

15. The interlocking masonry unit of claim 14, wherein the sloped outer edges form a mortar seam when the masonry unit is positioned vertically adjacent to a second identical interlocking masonry unit.

16. The interlocking masonry unit of claim 13, wherein the at least one port depression includes a top opening at the upper surface of the body and a base below the upper surface of the body, the top opening having a diameter greater than a diameter of the base.

* * * * *